US010208767B2

(12) United States Patent
Lin et al.

(10) Patent No.: US 10,208,767 B2
(45) Date of Patent: Feb. 19, 2019

(54) FAN MODULE AND ELECTRONIC DEVICE

(71) Applicant: Acer Incorporated, New Taipei (TW)

(72) Inventors: Kuang-Hua Lin, New Taipei (TW); Wen-Neng Liao, New Taipei (TW); Cheng-Wen Hsieh, New Taipei (TW)

(73) Assignee: Acer Incorporated, New Taipei (TW)

( * ) Notice: Subject to any disclaimer, the term of this patent is extended or adjusted under 35 U.S.C. 154(b) by 348 days.

(21) Appl. No.: 15/089,030

(22) Filed: Apr. 1, 2016

(65) Prior Publication Data

US 2017/0152864 A1 Jun. 1, 2017

(30) Foreign Application Priority Data

Nov. 27, 2015 (TW) ..... 104219169 U

(51) Int. Cl.
*F04D 29/44* (2006.01)
*F04D 29/58* (2006.01)

(52) U.S. Cl.
CPC ..... *F04D 29/582* (2013.01); *F04D 29/441* (2013.01); *F05D 2260/607* (2013.01)

(58) Field of Classification Search
CPC ..... F04D 29/582; F04D 29/441; F05D 2260/607; F28D 2021/0028; F28D 2021/0029; H01L 23/40; H01L 23/46; H01L 23/467; H01L 23/3672; F28F 3/02; F28F 13/00; F28F 23/00; G06F 1/20; G06F 1/203; G06F 1/206; G06F 2200/201; G06F 2200/202; G06F 2200/203; H05K 7/20136; H05K 7/20145
USPC ..... 165/80.3, 185; 361/679.47, 679.48, 361/679.52, 679.54, 679.55, 695, 697, 361/700, 703, 704, 709
See application file for complete search history.

(56) References Cited

U.S. PATENT DOCUMENTS 7,362,568 B2 * 4/2008 Huang ..... F04D 29/703 257/E23.099
7,911,781 B2 * 3/2011 Chao ..... G06F 1/203 361/679.47
8,102,649 B2 * 1/2012 Ma ..... H05K 7/20172 165/185
8,902,581 B2 * 12/2014 Goto ..... G06F 1/203 165/104.33

(Continued)

FOREIGN PATENT DOCUMENTS

CN 102958324 3/2013
CN 102984915 3/2013

(Continued)

*Primary Examiner* — Justin M Jonaitis
(74) *Attorney, Agent, or Firm* — J.C. Patents

(57) ABSTRACT

A fan module and an electronic device are provided. The fan module includes a fan housing, a fan and a heat dissipating member. The fan housing has an open side and an enclosing side which surrounds the open side, wherein the open side is provided with a first airflow guiding channel. The fan is disposed within the fan housing, the heat dissipating member is disposed at the open side, the heat dissipating member has a second airflow guiding channel which is communicated with the first airflow guiding channel, and the air generated by the fan passes through the first airflow guiding channel and the second airflow guiding channel and flows out for dust exhausting. The electronic device includes a chassis and the fan module, and the fan module is mounted in the chassis.

9 Claims, 5 Drawing Sheets

(56) References Cited

U.S. PATENT DOCUMENTS

| | | | | |
|---|---|---|---|---|
| 2006/0039113 | A1* | 2/2006 | Cheng | B01D 46/40 361/700 |
| 2007/0131383 | A1* | 6/2007 | Hattori | B01D 46/10 165/11.2 |
| 2009/0223649 | A1* | 9/2009 | Lee | F28G 1/08 165/95 |
| 2010/0073867 | A1 | 3/2010 | Tachikawa | |
| 2010/0073874 | A1* | 3/2010 | Tachikawa | G06F 1/203 361/695 |
| 2010/0073875 | A1* | 3/2010 | Suzuki | F28D 15/0275 361/695 |

FOREIGN PATENT DOCUMENTS

| | | |
|---|---|---|
| CN | 104279169 | 1/2015 |
| TW | M270405 | 7/2005 |

* cited by examiner

FAN MODULE AND ELECTRONIC DEVICE

CROSS-REFERENCE TO RELATED APPLICATION

This application claims the priority benefit of Taiwan application serial no. 104219169, filed on Nov. 27, 2015. The entirety of the above-mentioned patent application is hereby incorporated by reference herein and made a part of this specification.

BACKGROUND OF THE DISCLOSURE

1. Field of the Disclosure

The disclosure relates to a fan module and an electronic device, and relates particularly to a fan module and an electronic device with a structural design different than that of conventional fan modules and electronic devices.

2. Description of Related Art

FIG. 1 and FIG. 2 are schematic views of a conventional fan module, and FIG. 3 is a schematic view showing a portion of a chassis of an electronic device. Referring to FIG. 1, FIG. 2 and FIG. 3, among the dust exhausting designs which are widely used in the fan module 100, one of them is configured to: including a dust exhausting channel which is formed at an opening formed on the side wall 112 of the fan housing 110, wherein the dust exhausting channel is communicated with the dust collecting chamber 113 located outside the side wall 112 of the fan housing 110, and through the positive and negative rotation control circuit, a heat dissipating wind is provided during the positive rotation of the fan 120 while the dust is blown into the dust collecting chamber 113 during the negative rotation of the fan 120. The main disadvantage of the conventional dust exhausting design is that an opening is necessary to be formed on the side wall 112 of the fan housing 110, and it could easily lead to the loss of amount of airflow during the normal operating of the fan 120, and thus it could affect the performance of the fan module 100. In addition, the dust collecting chamber 113 is designed located at the outside of the side wall 112 of the fan housing 110, resulting that an additional protruding structure is necessary to be formed on the fan housing 110, this structure causes the electronic device 150 to have less flexibility for arranging components in the internal space thereof, therefore the position of the fan module 100 is commonly designed to be located at a corner of the electronic device 150, so as to prevent the protruding structure from interfering with other components such as rotating axis structure. Moreover, since an additional broken hole 152 is necessary to be formed on the external housing of the electronic device 150 for exhausting dust (as shown in FIG. 3), often resulting in industrial design considerations and restriction in appearance.

SUMMARY OF THE DISCLOSURE

The disclosure provides a fan module, and its structural design is different than the structural design of conventional fan modules.

The disclosure provides an electronic device, and the structural design of fan module applied therein is different than the structural design of conventional fan modules.

A fan module of an embodiment of the disclosure includes a fan housing, a fan and a heat dissipating member. The fan housing has an open side and an enclosing side which surrounds the open side, wherein the open side is provided with a first airflow guiding channel. The fan is disposed within the fan housing, and the heat dissipating member is disposed at the open side, and the heat dissipating member has a second airflow guiding channel which is communicated with the first airflow guiding channel, and the air generated by the fan passes through the first airflow guiding channel and the second airflow guiding channel and flows out for dust exhausting.

An electronic device of an embodiment of the disclosure includes a chassis and the abovementioned fan module mounted in the chassis.

According to an exemplary embodiment of the disclosure, the fan housing has a side wall and a guiding wall, and a first airflow guiding channel is formed by the side wall and the guiding wall.

According to an exemplary embodiment of the disclosure, the second airflow guiding channel is formed by hollowing a portion of the heat dissipating member.

According to an exemplary embodiment of the disclosure, the heat dissipating member includes a heat sink body and a plurality of heat dissipating fins, and the heat dissipating fins are disposed at a near side, which is near to the fan, of the heat sink body and a far side, which is far from the fan, of the heat sink body. Each of the heat dissipating fins located at the far side has a length protruded from the heat sink body, the length of each of the heat dissipating fins located at an outlet of the second airflow guiding channel is shorter than the length of each of the rest of the heat dissipating fins located at the far side, so as to form a yielding area, the chassis has a heat dissipating outlet, and the yielding area is correspondingly located in the heat dissipating outlet. The heat dissipating member further includes a heat pipe disposed on the heat sink body.

In light of the above, no dust collecting chamber is disposed and no hole is additionally disposed on the side wall of the fan housing of the fan module for collecting dust, whereas guiding channels for air to flow out are disposed within the fan housing and at the heat dissipating member, so as to optimize the design of the shape and dimension of the fan housing.

To make the above features and advantages of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
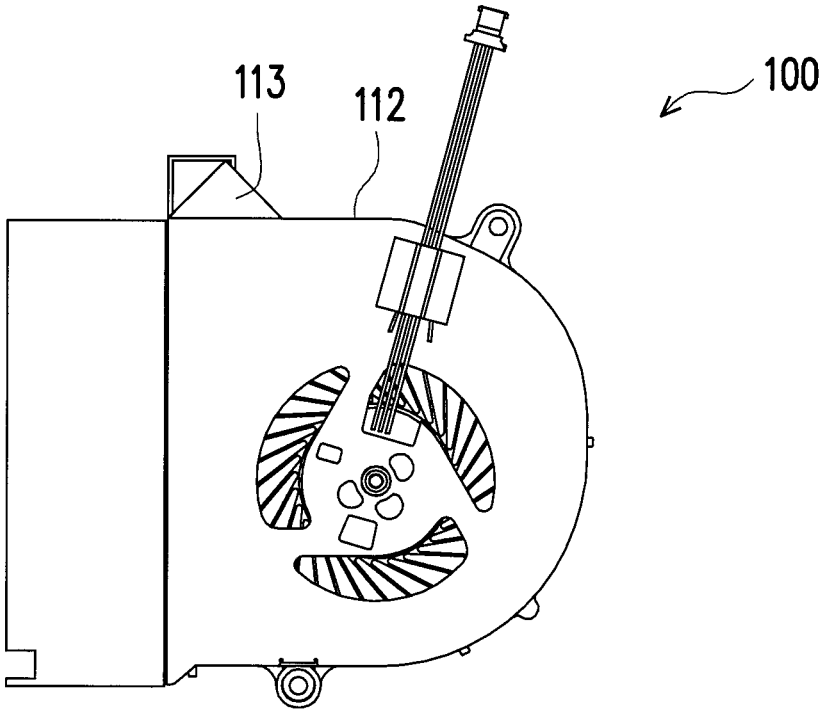
FIG. 1 and FIG. 2 are schematic views of a conventional fan module.
Figure 2:
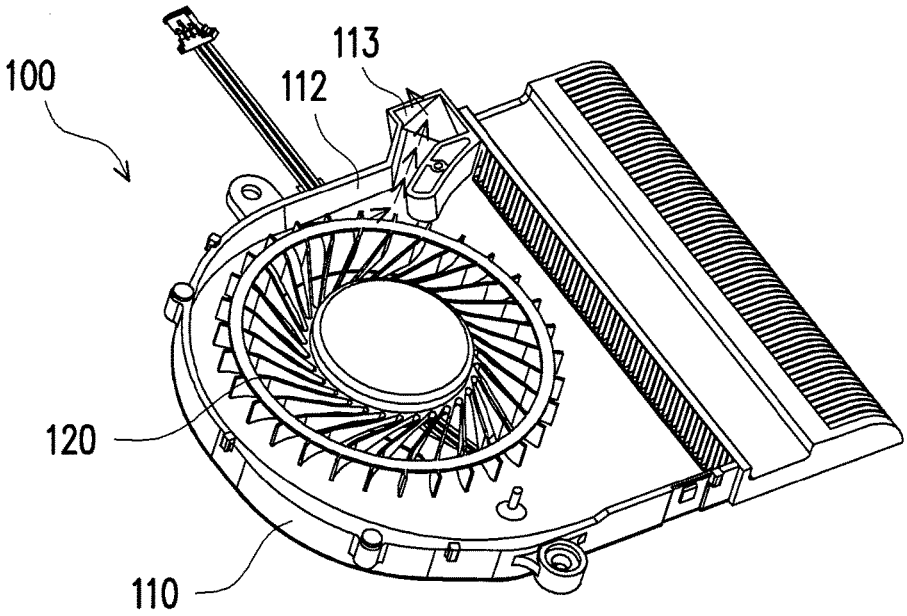
Figure 3:
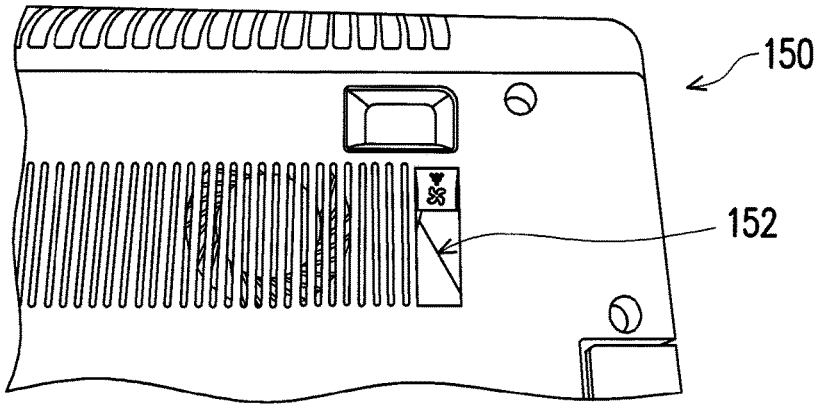
FIG. 3 is a schematic view showing a portion of a chassis of an electronic device.
Figure 4:
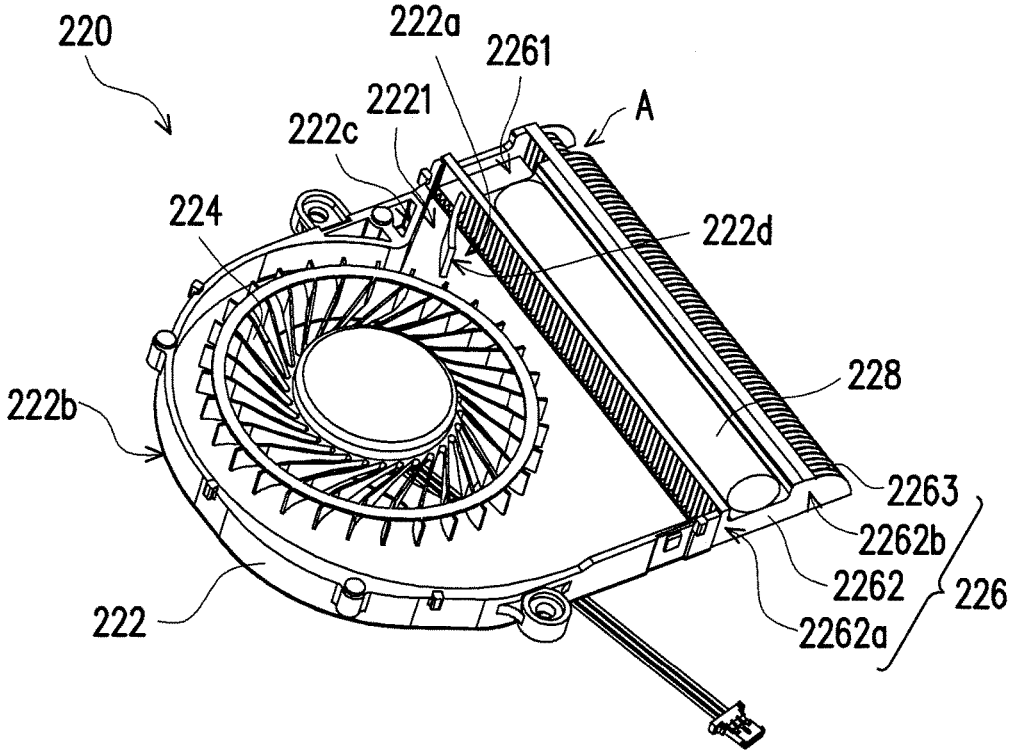
FIG. 4 is a schematic view of a fan module.
Figure 5:
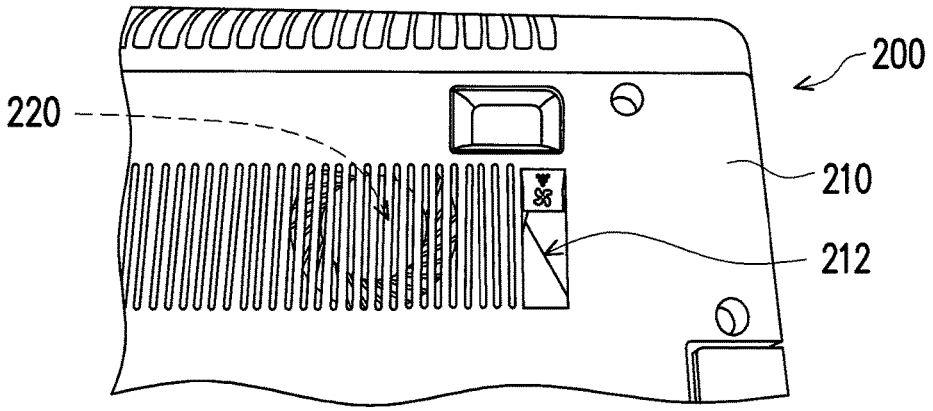
FIG. 5 is a schematic view showing that the fan module of FIG. 4 is applied in an electronic device.

FIG. 4 is a schematic view of a fan module. FIG. 5 is a schematic view showing that the fan module of FIG. 4 is applied in an electronic device. Referring to FIG. 4 and FIG. 5, the electronic device 200 includes a chassis 210 and a fan module 220 mounted in the chassis 210. The electronic device 200 in the present disclosure is taking a notebook computer for example. The fan module 220 includes a fan housing 222, a fan 224 and a heat dissipating member 226. The fan housing 222 has an open side 222*a* and an enclosing side 222*b* which surrounds the open side 222*a*, wherein a first airflow guiding channel 2221 is disposed at the open side 222*a*. The fan 224 is disposed within the fan housing 222, the heat dissipating member 226 is disposed at the open side 222*a*, the heat dissipating member 226 has a second airflow guiding channel 2261 which is communicated with the first airflow guiding channel 2221, and the air generated by the fan 224 passes through the first airflow guiding channel 2221 and the second airflow guiding channel 2261 and flows out for dust exhausting.

In detailed, the fan housing 222 has a side wall 222*c* and a guiding wall 222*d*, wherein the first airflow guiding channel 2221 is formed by the side wall 222*c* and the guiding wall 222*d*, while the second airflow guiding channel 2261 connecting with the first airflow guiding channel 2221 is formed by hollowing a portion of the heat dissipating member 226. In addition, the heat dissipating member 226 includes a heat sink body 2262 and a plurality of heat dissipating fins 2263, wherein the heat dissipating fins 2263 are disposed at the near side 2262*a* of the heat sink body 2262 near to the fan 224 and the far side 2262*b* of the heat sink body 2262 far from the fan 224. Each of the heat dissipating fins 2263 located at the far side 2262*b* has a length protruded from the heat sink body 2262, and the length of each of the heat dissipating fins 2263 located at the outlet of the second airflow guiding channel 2261 is shorter than the length of each of the rest of the heat dissipating fins 2263 located at the far side 2262*b*, so as to form a yielding area A. The chassis 210 has a heat dissipating outlet 212, and the yielding area A is located correspondingly within the heat dissipating outlet 212.

In order to improve the heat dissipating efficiency, the heat dissipating member 226 may further include a heat pipe 228 disposed on the heat sink body 2262.

Figure 6:
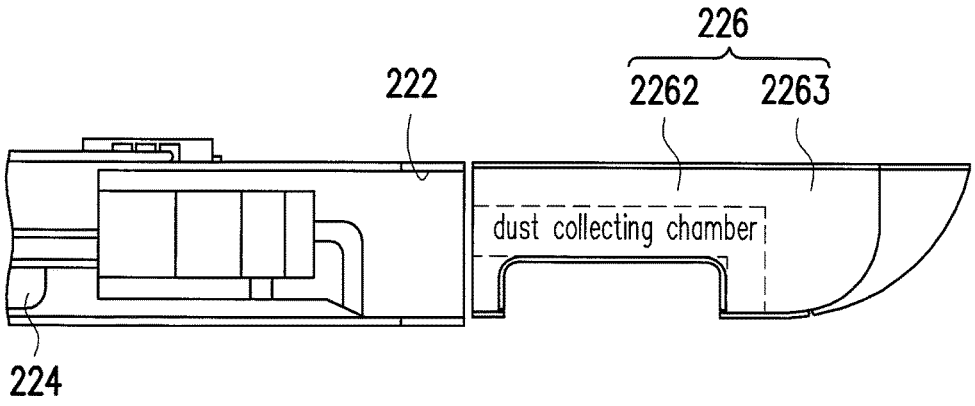
FIG. 6 is a schematic view showing a flow channel of a dust exhausting path of the fan module of FIG. 4.

The fan module 220 operates when the electronic device 200 operates, in order to effectively dissipate the heat of the heat generating component within the electronic device 200. In detailed, during the positive rotation of the fan 224, the fan module 220 provides a heat dissipating function. FIG. 6 is a schematic view showing a flow channel of a dust exhausting path of the fan module 220 of FIG. 4. Referring to FIG. 6, incidentally, the first airflow guiding channel 2221 is located in the weak air region of the whole fan module 220, and during the positive rotation of the fan 224, the dust is driven by wind generated by the fan 224 and passes through the first airflow guiding channel 2221 and then accumulated at the second airflow guiding channel 2261, therefore the second airflow guiding channel 2261 which is located at the heat dissipating member 226 may provide a function as the dust collecting chamber 113 of the conventional fan module 100.

Compared to the conventional fan module 100 in which the protruding structure protruded from the fan housing 110 which serves as the dust collecting chamber 113 is necessary, the fan housing 222 of the fan module 220 of the embodiment does not include any protruding structure which is additionally protruded therefrom, using ingenuity of a plan, a channel structure is formed on the heat dissipating member 226, so that the second airflow guiding channel 2261 may not only serve as a part of the dust exhausting path, but also may provide a function of dust collecting chamber.

In addition, since no hole is disposed on the side wall 222*c* of the fan housing 222, the flow of the air is not affected.

During the negative rotation of the fan 224, the fan module 220 performs dust exhausting.

Figure 7A:
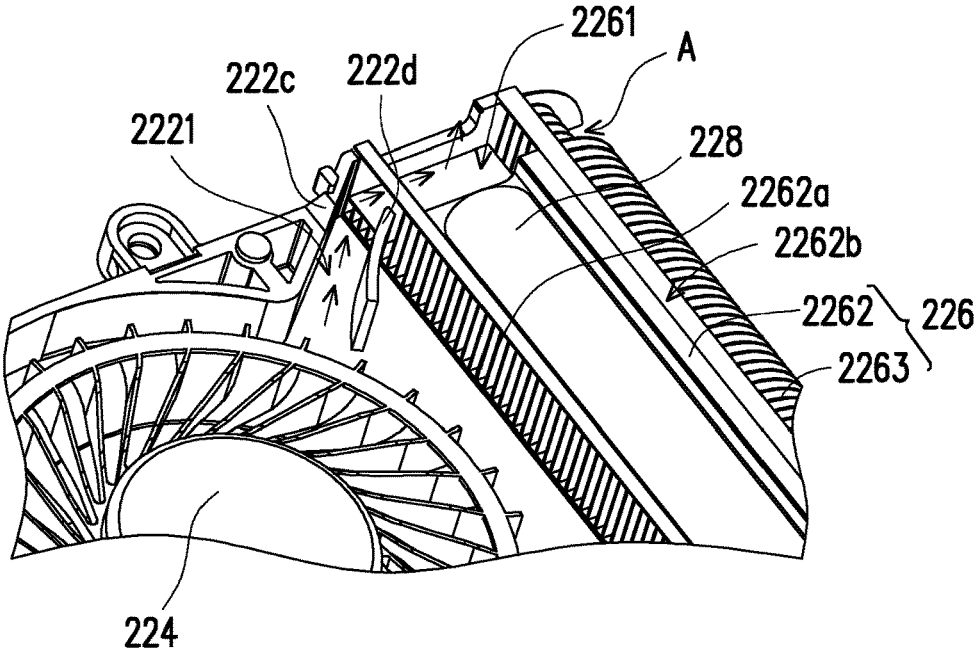
FIG. 7A is a schematic perspective view of the dust exhausting path of the fan module.
Figure 7B:
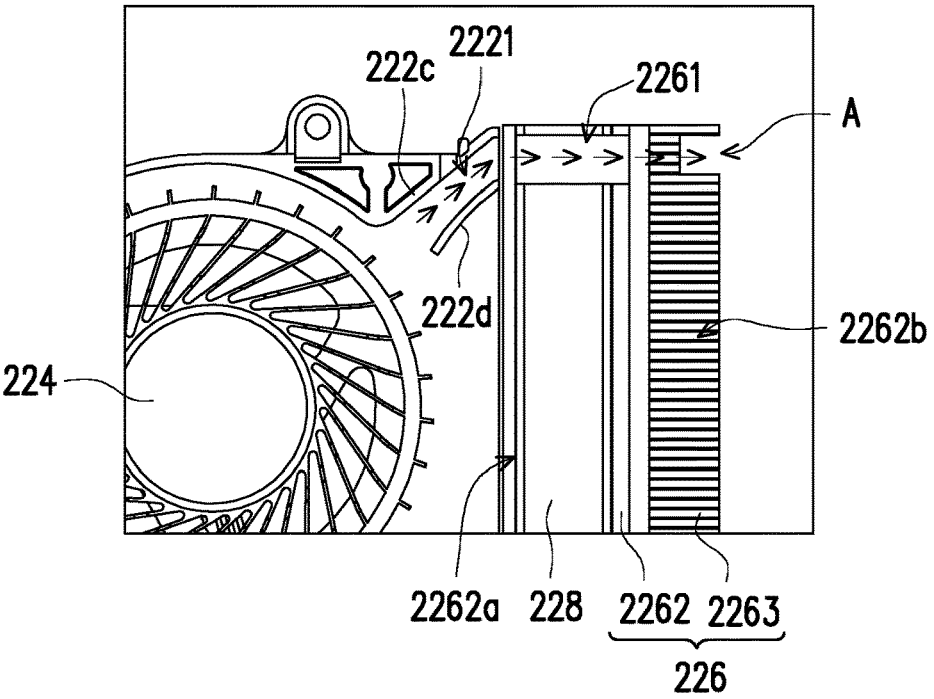
FIG. 7B is a top view of FIG. 7A.

FIG. 7A is a schematic perspective view of the dust exhausting path of the fan module, and FIG. 7B is a top view of FIG. 7A. Referring to FIG. 7A and FIG. 7B, when the fan 224 rotates reversely, the wind generated by the fan 224 passes through the first airflow guiding channel 2221 and the second airflow guiding channel 2261 and flows out from the outlet of the second airflow guiding channel 2261. Particularly, since each of the heat dissipating fins 2263 located at the far side 2262*b* has a length, by designing the length of each of the heat dissipating fins 2263 located at the outlet of the second airflow guiding channel 2261 to be shorter than the length of each of the rest of the heat dissipating fins 2263 located at the far side 2262*b*, the wind which passes through the second airflow guiding channel 2261 may exhaust the dust which are accumulated at the second airflow guiding channel 2261, and the dust may pass through the yielding area A which is in the area of the heat dissipating outlet 212, and due to natural gravity, falls to the outside of the chassis 210 of the electronic device 200. The heat dissipating outlet 212 is a broken hole which is originally disposed on the chassis 210 corresponding to the fan module 220, no need to additionally dispose any broken hole, thereby the amount of the broken holes on the chassis 210 may be reduced.

In light of the foregoing, the fan module and the electronic device in which the fan module is employed may at least achieve the following advantages:

1. Under the condition of without affecting the outer appearance of the fan housing and the performance of the fan module, the first airflow guiding channel is disposed in the fan housing, and the second airflow guiding channel which is communicated with the first airflow guiding channel is disposed on the heat dissipating member, and this second airflow guiding channel is located at the weak wind region, therefore during the positive rotation of the fan, the second airflow guiding channel may serve as a dust collecting chamber; and during the negative rotation of the fan, the second airflow guiding channel may guide the airflow to pass through and flow out.

2. Since each of the heat dissipating fins located at the far side has a length, through the design of the length of each of the heat dissipating fins located at the outlet of the second airflow guiding channel to be shorter than the length of the each of the rest of the heat dissipating fins located at the far side, so wind resistance is less in this region, in addition to the forced airflow generated by the fan, resulting that the wind which passes through the second airflow guiding channel may forcibly exhaust the dust accumulated at the second airflow guiding channel, and thus it is ensured that all of the dust is exhausted to the outside of the chassis of the electronic device.

3. The dust passes through the backward region which is located in the region of the heat dissipating outlet and falls to the outside of the chassis of the electronic device due to natural gravity.

4. No dust collecting chamber or no broken hole on the side wall of the fan housing is additionally disposed in the fan module, whereas guiding channels which can guide the wind to flow out are disposed in the fan housing and at the heat dissipating member, so that the design of the shape and dimension of the fan housing is optimized, thereby the internal space of the chassis of the electronic device may have more flexibility for arranging other components.

Although the disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A fan module, comprising:

a fan housing, having an open side and an enclosing side which surrounds the open side, wherein a first airflow guiding channel is disposed at the open side;

a fan, disposed in the fan housing; and a heat dissipating member, disposed at the open side, wherein the heat dissipating member has a second airflow guiding channel, the second airflow guiding channel is communicated with the first airflow guiding channel, and an air generated by the fan passes through the first airflow guiding channel and the second airflow guiding channel and flows out for dust exhausting, wherein the heat dissipating member comprises a heat sink body and a plurality of heat dissipating fins, and the heat dissipating fins are disposed at a near side, which is near to the fan, of the heat sink body and a far side, which is far from the fan, of the heat sink body, wherein each of the heat dissipating fins located at the far side has a length protruded from the heat sink body, the length of each of the heat dissipating fins located at an outlet of the second airflow guiding channel is shorter than the length of each of the rest of the heat dissipating fins located at the far side.

2. The fan module as claimed in claim 1, wherein the fan housing has a side wall and a guiding wall, and the first airflow guiding channel is formed by the side wall and the guiding wall.

3. The fan module as claimed in claim 1, wherein the second airflow guiding channel is formed by hollowing out a portion of the heat dissipating member.

4. The fan module as claimed in claim 1, wherein the heat dissipating member further comprises a heat pipe disposed on the heat sink body.

5. An electronic device, comprising:

a chassis;

a fan module, disposed within the chassis, comprising:

a fan housing, having an open side and an enclosing side which surrounds the open side, wherein a first airflow guiding channel is disposed at the open side;

a fan, disposed in the fan housing; and a heat dissipating member, disposed at the open side, wherein the heat dissipating member has a second airflow guiding channel, the second airflow guiding channel is communicated with the first airflow guiding channel, and an air generated by the fan passes through the first airflow guiding channel and the second airflow guiding channel and flows out for dust exhausting, wherein the heat dissipating member comprises a heat sink body and a plurality of heat dissipating fins, and the heat dissipating fins are disposed at a near side, which is near to the fan, of the heat sink body and a far side, which is far from the fan, of the heat sink body, wherein each of the heat dissipating fins located at the far side has a length protruded from the heat sink body, the length of each of the heat dissipating fins located at an outlet of the second airflow guiding channel is shorter than the length of each of the rest of the heat dissipating fins located at the far side, so as to form a yielding area.

6. The electronic device as claimed in claim 5, wherein the fan housing has a side wall and a guiding wall, and the first airflow guiding channel is formed by the side wall and the guiding wall.

7. The electronic device as claimed in claim 5, wherein the second airflow guiding channel is formed by hollowing out a portion of the heat dissipating member.

8. The electronic device as claimed in claim 5, wherein the chassis has a heat dissipating outlet, and the yielding area is correspondingly located in the heat dissipating outlet.

9. The electronic device as claimed in claim5, wherein the heat dissipating member further comprises a heat pipe disposed on the heat sink body.

* * * * *